US010263343B2

(12) United States Patent
Flodin et al.

(10) Patent No.: US 10,263,343 B2
(45) Date of Patent: Apr. 16, 2019

(54) REFLECTOR ANTENNA ARRANGEMENT

(71) Applicant: TELEFONAKTIEBOLAGET LM ERICSSON (PUBL), Stockholm (SE)

(72) Inventors: Jonas Flodin, Onsala (SE); Thomas Emanuelsson, Västra Frölunda (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 336 days.

(21) Appl. No.: 15/022,796

(22) PCT Filed: Mar. 10, 2016

(86) PCT No.: PCT/EP2016/055208

§ 371 (c)(1),
(2) Date: Mar. 17, 2016

(87) PCT Pub. No.: WO2017/152988

PCT Pub. Date: Sep. 14, 2017

(65) Prior Publication Data

US 2018/0083366 A1 Mar. 22, 2018

(51) Int. Cl.

| | |
|---|---|
| ***H01Q 1/42*** | (2006.01) |
| ***H01Q 19/19*** | (2006.01) |
| *H01Q 25/00* | (2006.01) |

(52) U.S. Cl.

CPC ..... *H01Q 19/192* (2013.01); *H01Q 1/42* (2013.01); *H01Q 25/00* (2013.01)

(58) Field of Classification Search

CPC ..... H01Q 1/42; H01Q 19/192

See application file for complete search history.

(56) References Cited

U.S. PATENT DOCUMENTS

| | | | | |
|---|---|---|---|---|
| 5,084,711 A | | 1/1992 | Moss et al. | |
| 5,426,443 A | * | 6/1995 | Jenness, Jr. | H01Q 19/193 343/781 P |
| 2015/0330826 A1 | | 11/2015 | Kienzle | |

FOREIGN PATENT DOCUMENTS

| | | |
|---|---|---|
| EP | 0 084 420 A2 | 7/1983 |
| EP | 0 170 726 A1 | 2/1986 |
| GB | 2 168 854 A | 6/1986 |
| JP | S58 170203 A | 10/1983 |

* cited by examiner

*Primary Examiner* — Graham P Smith

(57) ABSTRACT

The present disclosure relates to a reflector antenna arrangement comprising at least a first reflective metal surface and a signal feeding arrangement transition that is adapted to receive a signal feeding arrangement that in turn is adapted to transmit and/or receive electromagnetic radiation via the first reflective metal surface. The reflector antenna arrangement further comprises a common dielectric body comprising at least one dielectric material, to which common dielectric body the first reflective metal surface is attached in a fixed relation to the signal feeding arrangement transition with a certain distance between them such that said transmitted and/or received electromagnetic radiation at least partly is arranged to propagate through at least a part of the common dielectric body.

20 Claims, 8 Drawing Sheets

REFLECTOR ANTENNA ARRANGEMENT

TECHNICAL FIELD

The present disclosure relates to a reflector antenna arrangement comprising at least a first reflective metal surface and a signal feeding arrangement that is adapted to transmit and/or receive electromagnetic radiation via the first reflective metal surface.

BACKGROUND

In wireless communication networks, there are communication nodes, for example microwave link nodes. Microwave link nodes normally comprise microwave link antenna devices that may be in the form of high gain antennas for high frequency applications. Such high gain antennas can be implemented by means of a variety of technical solutions such as parabolic dish antennas, horn antennas, dielectric lens antennas or flat panel array antennas.

General problems for high gain antennas at high frequencies are losses, front to back ratio and undesired lobe form, in particular excessive side lobe levels.

High gain antennas are often associated with narrow main lobes, i.e., they have small half-power beam-widths. A narrow main lobe focuses transmitted and received power and thus increases antenna gain. Half-power beam-width of most directional antennas is inversely proportional to both reflector area and carrier frequency. Thus, the higher the carrier frequency becomes, the narrower the main lobe becomes, and the larger the antenna gain becomes. Consequently, for a fixed antenna gain, reflector size can be decreased with increasing carrier frequency.

The smaller an antenna becomes, the more precision is required at manufacturing since the tolerances decrease correspondingly. Thus, high gain directional antennas become more difficult to manufacture with increasing carrier frequency/center frequency, since they are often much smaller in size than high gain antennas for lower carrier frequencies.

There is thus a need for a high gain antenna for use at high carrier frequencies having relatively low losses and desired lobe shapes, and which is less complicated to manufacture compared to prior art.

SUMMARY

It is an object of the present disclosure to provide a high gain antenna for use at high carrier frequencies having relatively low losses and desired lobe shapes, and which is less complicated to manufacture compared with prior art.

Said object is obtained by means of a reflector antenna arrangement comprising at least a first reflective metal surface and a signal feeding arrangement transition that is adapted to receive a signal feeding arrangement that in turn is adapted to transmit and/or receive electromagnetic radiation via the first reflective metal surface. The reflector antenna arrangement further comprises a common dielectric body comprising at least one dielectric material. The first reflective metal surface is attached to the common dielectric body in a fixed relation to the signal feeding arrangement transition with a certain distance between them such that said transmitted and/or received electromagnetic radiation at least partly is arranged to propagate through at least a part of the common dielectric body.

It is also an object of the present disclosure to provide a manufacturing method for manufacturing a reflector antenna arrangement according to the above.

This object is obtained by means of a method for manufacturing a reflector antenna arrangement, where the method comprises:

- Forming a common dielectric body comprising at least one dielectric material.
- Forming a signal feeding arrangement transition in the common dielectric body, where the signal feeding arrangement transition is used for receiving a signal feeding arrangement that in turn is used for transmitting and/or receiving electromagnetic radiation via the first reflective metal surface.
- Attaching at least a first reflective metal surface to the common dielectric body.
- Performing said attaching such that said first reflective metal surface and said signal feeding arrangement transition have a fixed relation to each other with a certain distance between them, enabling said transmitted and/or received electromagnetic radiation to at least partly propagate through at least a part of the common dielectric body.

A number of advantages are obtained by means of the present disclosure. Mainly, an easily manufactured high performance antenna for high frequencies is obtained at low cost, maintaining a high degree of manufacturing precision which in turn leads to low losses and desired lobe shapes.

According to an example, the reflector antenna arrangement comprises a second reflective metal surface attached to the common dielectric body in a fixed relation to the first reflective metal surface with a certain distance between them, where the first reflective metal surface and the second reflective metal surface are adapted for transfer of electromagnetic radiation between them by means of reflection.

In this way, a complete dual reflector antenna is formed in one single piece.

According to another example, each reflective metal surface is arranged on an outer surface of the common dielectric body.

According to another example, each reflective metal surface is arranged as a layer of metallic coating on a respective outer surface of the common dielectric body.

In this way, accurate positioning of the reflective metal surfaces is obtained in an uncomplicated manner, the reflective metal surfaces following the molded shape of the respective outer surface of the dielectric body.

According to another example, the common dielectric body is formed as one solid piece.

According to another example, the common dielectric body is formed as a hollow body.

In this way, a light-weight alternative is obtained.

According to another example, the common dielectric body comprises at least two different dielectric materials arranged in a layer structure.

In this way, certain beam characteristics may be determined by adapting said different dielectric materials and their relative arrangement in the layer structure.

According to another example, the common dielectric body comprises at least one surface part that has a matched shaped that provides a desired antenna radiation pattern and reflection characteristics.

In this way, certain beam characteristics may also be determined. In particular, a matching between the common dielectric body and a transmission medium, e.g., air, can be improved.

A number of general advantages are obtained by means of the present disclosure. Mainly, an easily manufactured high performance antenna for high frequencies is obtained at low cost, maintaining a high degree of manufacturing precision which in turn leads to low losses and desired lobe shapes. A complete reflector antenna, such as a dual reflector antenna, is manufactured in one single piece.

BRIEF DESCRIPTION OF THE DRAWINGS

The present disclosure will now be described more in detail with reference to the appended drawings, where.

DETAILED DESCRIPTION

Figure 1:
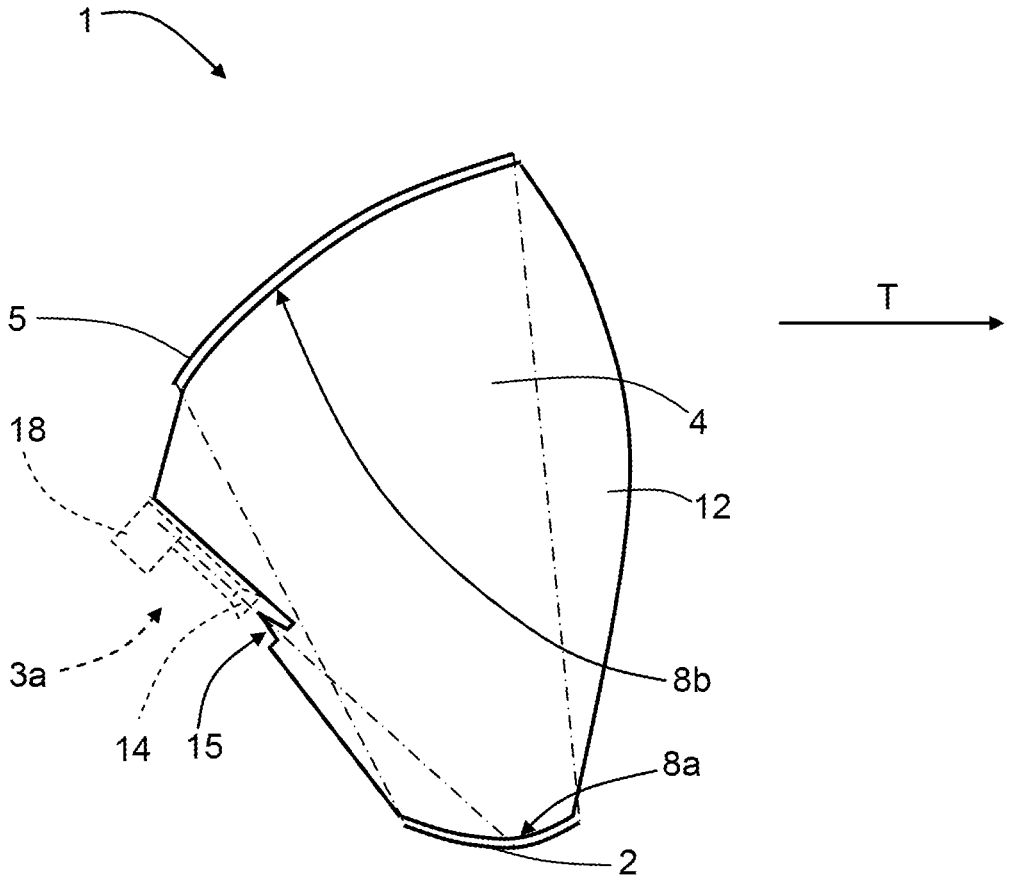
FIG. 1 shows a side view of a first example of a reflector antenna arrangement according to the present disclosure.
Figure 2:
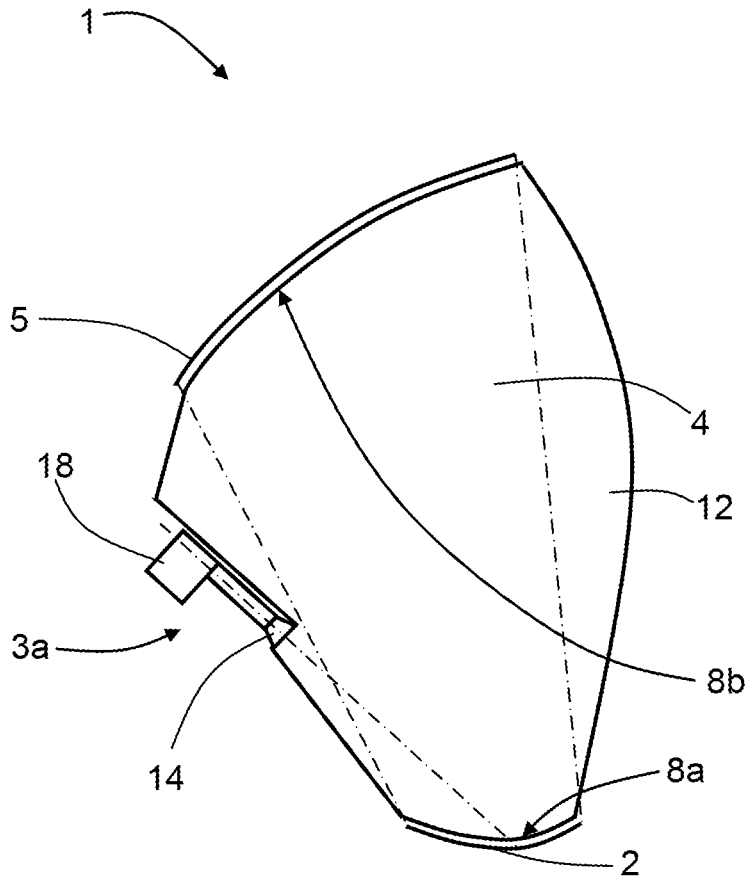
FIG. 2 shows the side view of FIG. 1 with a signal feeding arrangement attached.
Figure 3:
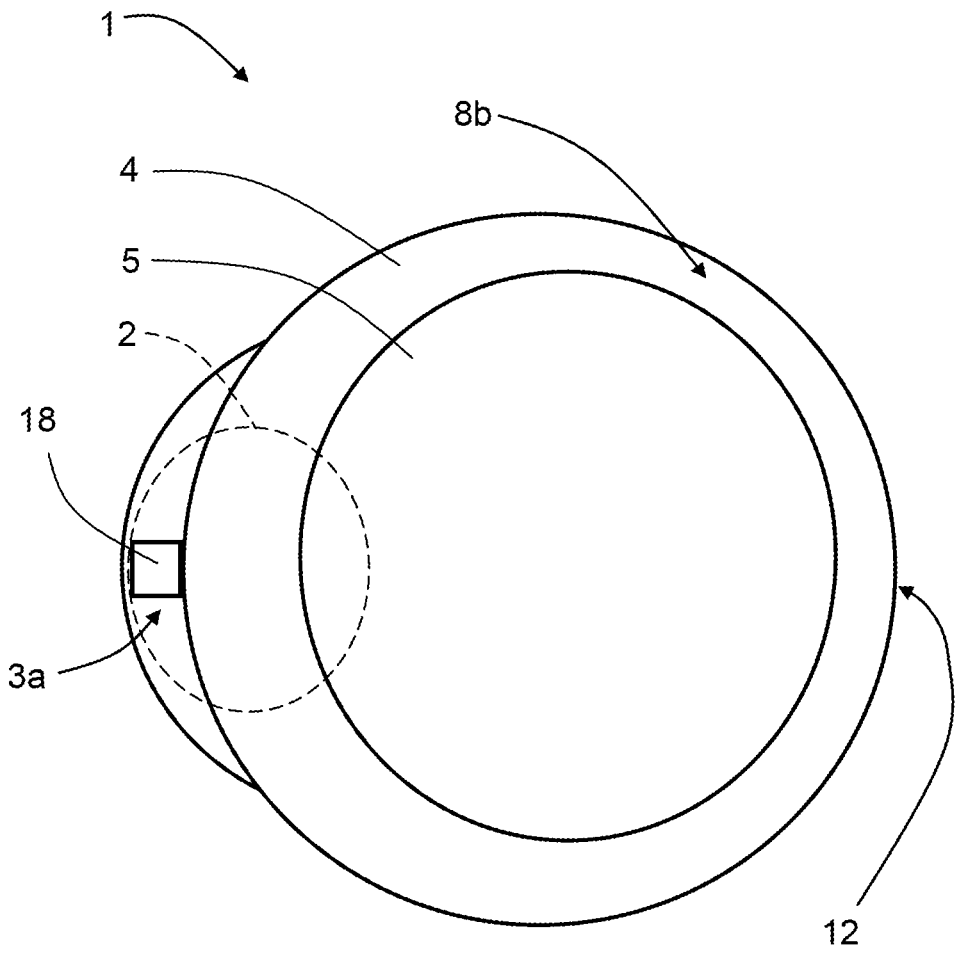
FIG. 3 shows a top view of the reflector antenna arrangement in FIG. 1.

With reference to FIG. 1, FIG. 2 and FIG. 3, showing a first example, there is a dual reflector antenna arrangement 1 that is designed for high performance and high gain for frequencies about and above 100 GHz. FIG. 1 and FIG. 2 show a side view of a first example of the reflector antenna arrangement, and FIG. 3 shows a corresponding top view.

The reflector antenna arrangement 1 comprises a first reflective metal surface 2 and a signal feeding arrangement transition 15, here in the form of a taper arrangement that is adapted for receiving a signal feeding arrangement 3*a* that in turn is adapted to transmit and/or receive electromagnetic radiation via the first reflective metal surface 2.

It is appreciated that the signal feeding arrangement 3*a* is optional. Alternatives include an integrated signal processing means, such as a radio device embedded in the common dielectric body. This integrated signal processing means is then configured to transmit and receive electromagnetic radiation, i.e., radio signals, via the signal feeding arrangement transition 15.

The signal feeding arrangement transition 15 is not necessarily in the form of a taper arrangement, but can take any shape suitable for passing electromagnetic radiation to and from the reflector antenna arrangement.

The reflector antenna arrangement 1 further comprises a second reflective metal surface 5, where the first reflective metal surface 2 and the second reflective metal surface 5 are adapted for transfer of electromagnetic radiation between them by means of reflection. In this example, the first reflective metal surface 2 constitutes a sub-reflector and the second reflective metal surface 5 constitutes a main reflector, where the signal feeding arrangement 3*a* thus is arranged to feed the sub-reflector 2 and where the sub-reflector 2 in turn is arranged to feed the main reflector 5. In FIG. 1, the signal feeding arrangement 3*a* is only indicated with dashed lines, intended to be attached to the taper arrangement 15 that constitutes the signal feeding arrangement transition in this example. In FIG. 2, the signal feeding arrangement is shown attached.

Again, it is appreciated that other means for feeding electromagnetic radiation, such as radio signals, to and from the reflector antenna arrangement 1 are possible, such as a radio device embedded in the common dielectric body.

According to the present disclosure, the reflector antenna arrangement 1 further comprises a common dielectric body 4 that is formed as one piece in a dielectric material. The first reflective metal surface 2, the second reflective metal surface 5 and the signal feeding arrangement 3*a* are attached to the common dielectric body 4; the reflective metal surfaces 2, 5 according to some aspects being arranged as corresponding layers of metallic coating on corresponding outer surfaces 8*a*, 8*b* of the common dielectric body 4, the reflective metal surfaces 2, 5 following the corresponding outer surface 8*a*, 8*b* of the common dielectric body 4.

Figure 5:
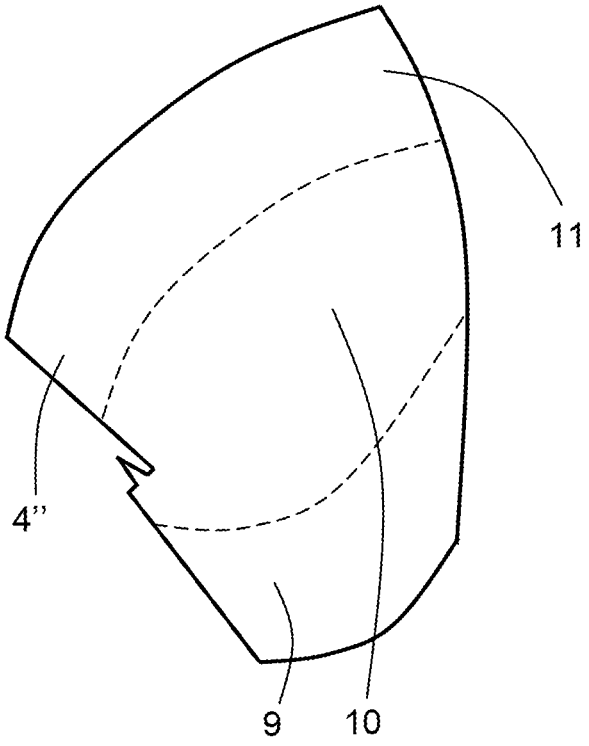
FIG. 5 shows an example of a common dielectric body that is formed in a layered structure.

The signal feeding arrangement 3*a* is in this example formed as a circular horn antenna 14*a* that is connected to a radio unit 18, as shown in FIG. 5, and is adapted to co-operate with the taper arrangement 15 that also is formed in the common dielectric body 4. The horn antenna 14*a* is here threaded onto the taper arrangement 15 and suitably attached such that its position is maintained, for example by means of gluing, and also by means of an external holding structure (not shown) that is attached to the common dielectric body 4.

In this manner, the first reflective metal surface 2 and the signal feeding arrangement 3*a* are attached in a fixed relation to each other with a certain distance between them such that said transmitted and/or received electromagnetic radiation is arranged to propagate through at least a part of the common dielectric body 4.

A typical reflector antenna is equipped with a feeder that radiates the signal towards a reflector dish. In this case, the placement of the feeding element is crucial for performance, and the effect of the feeder being in front of and in the center of the dish causes defects in the performance. An increased performance can be achieved by means of a dual reflector antenna that comprises two reflector dishes, where the feed illuminates a smaller reflector dish to redirect a focused beam to a main reflector dish.

A direction T of transmission and/or reception by the antenna arrangement 1 is indicated in FIG. 1. This direction T is mainly determined by the relative orientation, location and shape of the reflective metal surfaces 2, 5, and the signal feeding arrangement transition 15.

The reflector antenna arrangement 1 can be used, e.g., in a communication system or in a radar system. A signal processing device such as a radio or a radar transceiver is then connected to the reflector antenna arrangement 1 via the signal feeding arrangement transition 15. The signal processing device may then transmit and/or receive electromagnetic radiation, such as radio or radar signals, with high gain in the direction T.

Previously known dual reflector antennas have had the reflector parts formed as separate metal parts that have been mounted to each other and to a signal feeding arrangement by means of a frame structure or similar. Such a frame structure could comprise several holding members such as metal or plastic stays that run between the reflector parts and the signal feeding arrangement, keeping them in a certain relation to each other. Such a mounting is cumbersome to achieve if a high degree of precision is required, and it may also be difficult to maintain the mounting in its initial form over time.

In the antenna arrangement shown in FIG. 1, electromagnetic radiation is fed to the antenna arrangement via taper arrangement 15, is reflected via the first reflective metal surface 2, travels via the common dielectric body 4 before it is again reflected via the second reflective metal surface 5. The electromagnetic radiation reflected via the second reflective metal surface 5 is then output from the antenna arrangement as a transmitted signal, in the direction T.

The antenna arrangement of FIG. 1 is more easily manufactured than the previously known dual reflector antennas, since the common dielectric body 4 forms a well-defined and stable structure onto which the reflector parts, in form of the reflective metal surfaces 2, 5, are attached. The common dielectric body 4 also comprises a signal feeding arrangement transition 15 that allows a well-defined attachment of a signal feeding arrangement 3*a*.

The second reflective metal surface 5 is attached to the common dielectric body 4 in a fixed relation to the first reflective metal surface 2 with a certain distance between them, where the first reflective metal surface 2 and the second reflective metal surface 5 are adapted for transfer of electromagnetic radiation between them by means of reflection. The transferred electromagnetic radiation is arranged to propagate through at least a part of the common dielectric body 4.

The common dielectric body 4 comprises a surface part 12 that has a matched shape that provides a desired antenna radiation pattern and reflection characteristics. In particular, a matching between the common dielectric body and a transmission medium, e.g., air, can be improved by adapting the surface part 12 to different operating conditions.

In this manner, having an integrally formed common dielectric body 4 with reflective metal surfaces 2, 5 and a signal feeding arrangement 3*a* attached to it in a predefined manner provides an integrally formed antenna arrangement. Having a predefined relation and corresponding distances between the reflective metal surfaces 2, 5 and the signal feeding arrangement 3*a* as described above is relatively easy to obtain with a high level of accuracy by means of the common dielectric body 4 to which these parts are attached.

The dual reflector antenna in the antenna arrangement 1 is thus possible to realize at the desired frequencies by using a dielectric material, suitably a low loss dielectric material, that is molded such that is comprises outer surfaces 8*a*, 8*b* having the same shape as the reflective metal surfaces 2, 5 constituting the main reflector and the sub-reflector. The dielectric material is also molded such that it comprises the taper arrangement 15, or other signal feeding arrangement transition, that constitutes a transition between the common dielectric body 4 and the circular horn antenna 14*a*.

This brings all pieces of the dual reflector antenna into one integral single metallized dielectric piece, the common dielectric body 4, where the common dielectric body 4 can be molded with very high precision and easily be manufactured in high volumes. All assembly and critical adjustments of the feeder and reflectors will be avoided and moved into the manufacturing of the tool for molding resulting in a compact, high performance antenna with very low manufacturing cost. Depending on dielectric material, a relatively low temperature molding process is possible, further simplifying manufacturing the reflector antenna arrangement.

The specific geometry, i.e., size and shape of the common dielectric body and the relative location and orientation of reflective surfaces may be determined by computer simulation, analytical analysis, or by experimentation using prototypes and in-lab measurement of antenna characteristics.

Figure 4:
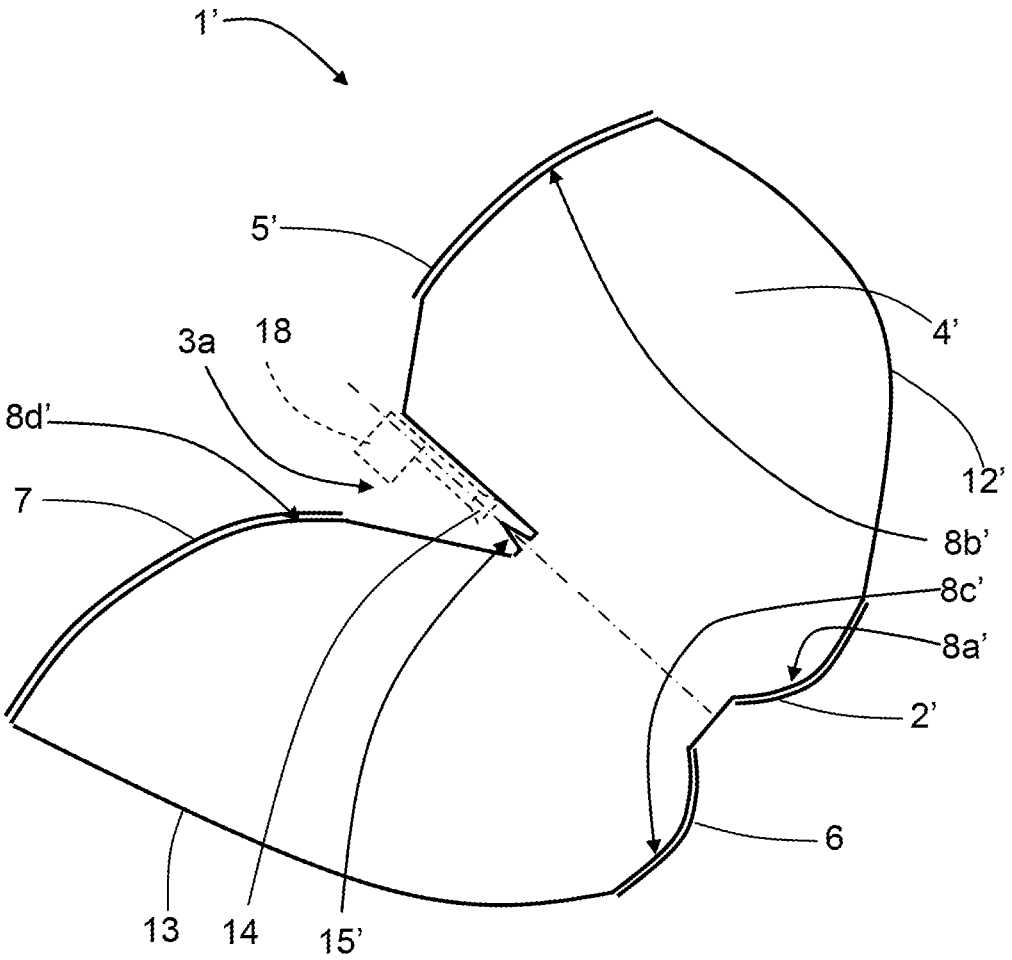
FIG. 4 shows a second example of a reflector antenna arrangement according to the present disclosure.

FIG. 4 shows a side view of a second example of the reflector antenna arrangement 1'. Here, the reflector antenna arrangement 1' a comprises a first reflective metal surface 2', a second reflective metal surface 5' and a signal feeding arrangement transition 15' that are arranged in a manner similar to the one described for the first example. As in FIG. 1, a signal feeding arrangement 3*a* is only indicated with dashed lines, intended to be attached to a taper arrangement that constitutes the signal feeding arrangement transition 15' in this example.

The reflector antenna arrangement 1' further comprises a third reflective metal surface 6 where the signal feeding arrangement 3*a* is adapted to transmit and/or receive electromagnetic radiation via the third reflective metal surface 6 as well. The reflector antenna arrangement 1' also comprises a fourth reflective metal surface 7 attached to the common dielectric body 4', where the third reflective metal surface 6 and the fourth reflective metal surface 7 are adapted for transfer of electromagnetic radiation between them by means of reflection.

In this manner, the third reflective metal surface 6 and the signal feeding arrangement 3*a* are attached in a fixed relation to each other with a certain distance between them such that said transmitted and/or received electromagnetic radiation is arranged to propagate through at least a part of the common dielectric body 4'.

Correspondingly, the fourth reflective metal surface 7 is attached to the common dielectric body 4' in a fixed relation to the third reflective metal surface 6 with a certain distance between them, where the third reflective metal surface 6 and the fourth reflective metal surface 7 are adapted for transfer of electromagnetic radiation between them by means of reflection. The transferred electromagnetic radiation is arranged to propagate through at least a part of the common dielectric body 4'.

In this example, the first reflective metal surface 2' constitutes a first sub-reflector and the second reflective metal surface 5' constitutes a first main reflector in a first reflector arrangement, where the signal feeding arrangement 3*a* thus is arranged to feed the first sub-reflector 2' and where the first sub-reflector 2 in turn is arranged to feed the first main reflector 5'.

Correspondingly, the third reflective metal surface 6 constitutes a second sub-reflector and the fourth reflective metal surface 7 constitutes a second main reflector in a second reflector arrangement, separate from the first reflector arrangement, where the signal feeding arrangement 3*a* thus is arranged to feed the second sub-reflector 6 and where the second sub-reflector 6 in turn is arranged to feed the second main reflector 7. The signal feeding arrangement 3*a* is here arranged to feed both reflector arrangement, according to some aspects independently of each other.

The common dielectric body 4' comprises two surface parts 12', 13 that each has a matched shaped that provides a desired antenna radiation pattern and reflection characteristics: a first surface part 12' for the first reflector arrangement of the first reflective metal surface 2' and the second reflective metal surface 5', and a second surface part 13 for the second reflector arrangement of the third reflective metal surface 6 and the fourth reflective metal surface 7.

Each reflective metal surface 2', 5', 6, 7 is according to some aspects arranged on a corresponding outer surface 8*a'*, 8*b'*, 8*c'*, 8*d'* of the common dielectric body 4', and may according to some aspects be arranged as corresponding layers of metallic coating on said corresponding outer surface 8*a*', 8*b*', 8*c*', 8*d*'.

As understood from the above, the signal feeding arrangement 3*a* may according to some aspects be arranged to feed even more reflector arrangements that are formed on and/or attached to the common dielectric body.

According to some aspects, several signal feeding arrangements may be used to feed several different dual reflector antenna arrangements. To simplify, e.g., deployment, the several different dual reflector arrangements may be formed from one single common dielectric body.

The common dielectric body 4, 4' is according to one aspect formed as one solid piece, and according to another aspect, the common dielectric body 4, 4' is formed as a hollow body.

With reference to FIG. 5, showing a side view of a common dielectric body 4", the common dielectric body 4" comprises three different dielectric materials 9, 10, 11, arranged in a layered structure. Generally, the common dielectric body may comprise a plurality of dielectric materials arranged in a layered structure or more generally in in an embedded manner where one dielectric material at least partly may enclose another dielectric material. A layered structure is a structure that is formed by two or more layers of different materials that are brought together to form an integral structure.

According to some aspects, the common dielectric body is 4, 4' at least partly formed in at least one of following materials, alone or in a mixture:

PTFE (polytetrafluoroethylene) with or without re-enforcement;

glass;

PVC (polyvinylchloride);

ceramics;

PC (polycarbonate); and

PU (polyurethane).

Many other materials and combinations are of course possible.

According to some aspects, the signal feeding arrangement 3*a*, 3*b*, 3*c*, 3*d*, 3*e* comprises a radio or radar unit 18 that is connected to a radiating device. In the following, a number of examples of radiating devices will be presented. The radio or radar unit may be embedded in the common dielectric body, thus forming an integral unit.

Figure 6:
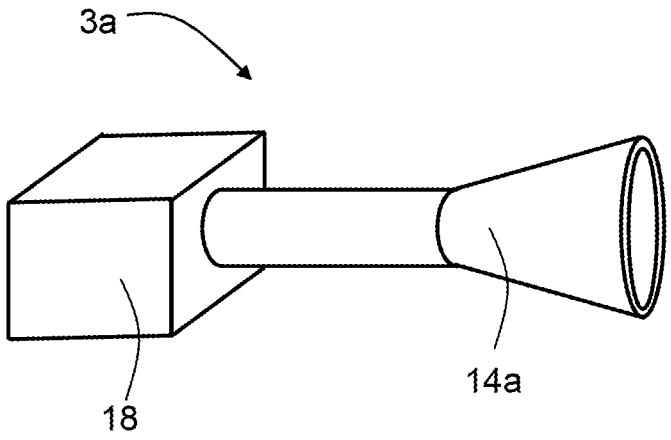
FIG. 6 shows a first example of a signal feeding arrangement.

With reference to FIG. 6, the signal feeding arrangement 3*a* comprises a radiating device in the form of a circular feeding horn antenna 14*a* adapted to co-operate with a taper arrangement 15, 15' formed in the common dielectric body 4, 4'.

Figure 7:
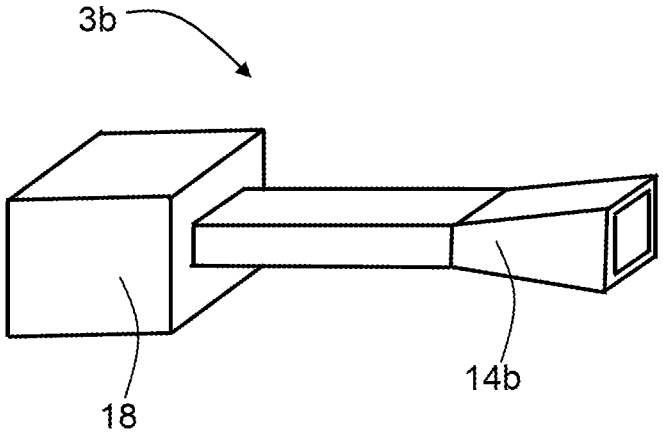
FIG. 7 shows a second example of a signal feeding arrangement.

With reference to FIG. 7, the signal feeding arrangement 3*b* comprises a radiating device in the form of a square feeding horn antenna 14*b* adapted to co-operate with a taper arrangement 15, 15' formed in the common dielectric body 4, 4'.

Figure 8:
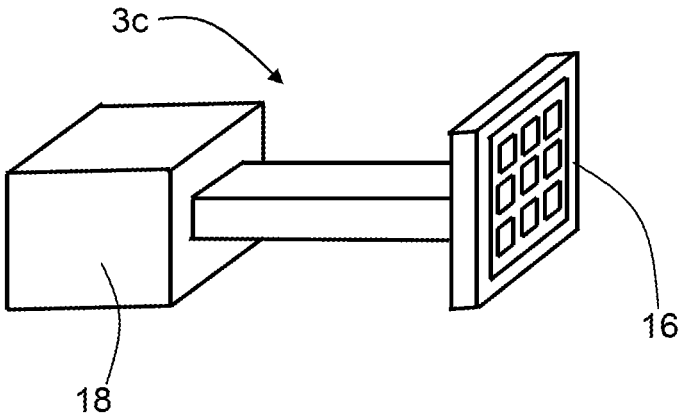
FIG. 8 shows a third example of a signal feeding arrangement.

With reference to FIG. 8, the signal feeding arrangement 3*c* comprises a radiating device in the form of a patch antenna arrangement 16.

Figure 9:
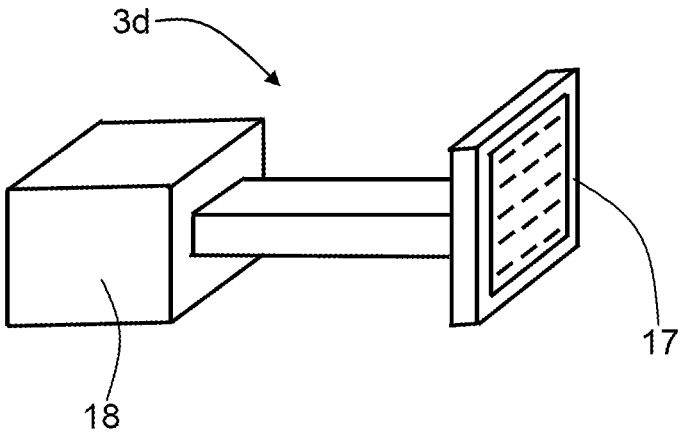
FIG. 9 shows a fourth example of a signal feeding arrangement.

With reference to FIG. 9, the signal feeding arrangement 3*d* comprises a radiating device in the form of a slot antenna arrangement 17.

The patch antenna arrangement 16 and slot antenna arrangement 17 are examples of feeding array antennas. According to an aspect, such a feeding array antenna 16, 17 is constituted by an electrically controlled antenna.

Figure 10:
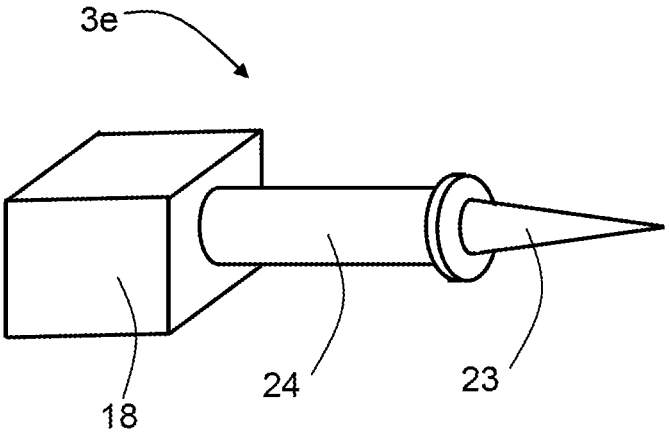
FIG. 10 shows a fifth example of a signal feeding arrangement.

With reference to FIG. 10, the signal feeding arrangement 3*e* comprises a radiating device in the form of a dielectric rod 23 attached to a circular waveguide 24. The dielectric rod 23 may be comprised in the common dielectric body, or fitted to the circular waveguide 24 as a separate part. In the latter case, according to some aspects, there is a corresponding opening in the common dielectric body 4 that is adapted to receive the dielectric rod 23.

For all signal feeding arrangements 3*a*, 3*b*, 3*c*, 3*d*, 3*e*, there is a corresponding signal feeding arrangement transition formed in the common dielectric body 4, such as for example a taper arrangement 15, an opening in the common dielectric body 4, or an attachment guide or other type of attachment arrangement.

Figure 11:
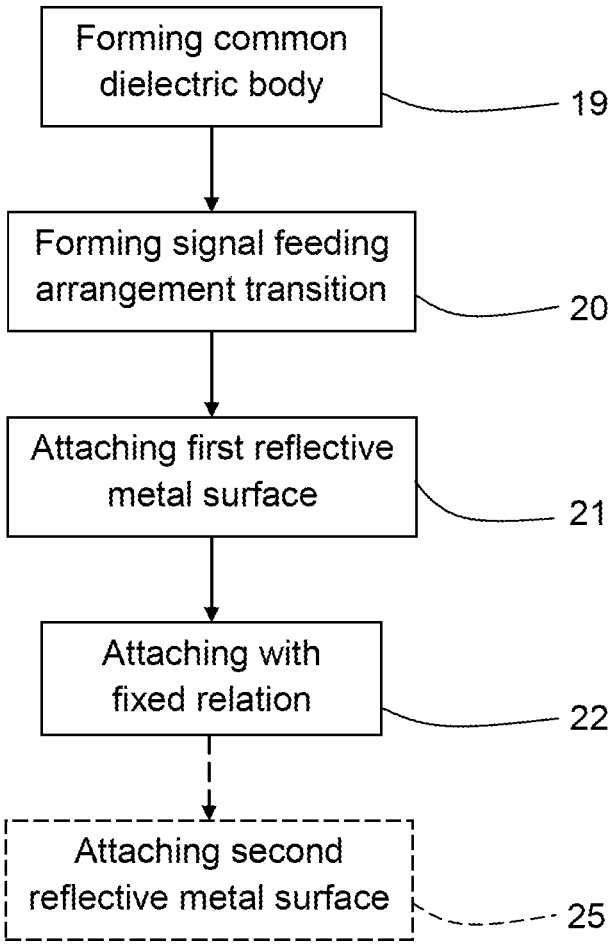
FIG. 11 shows a flowchart for a manufacturing method.

With reference to FIG. 11, the present disclosure is also directed towards a method for manufacturing a reflector antenna arrangement 1, wherein the method comprises:

19: Forming a common dielectric body 4 comprising at least one dielectric material.

20: Forming a signal feeding arrangement transition 15 in the common dielectric body 4, where the signal feeding arrangement transition 15 is used for receiving a signal feeding arrangement 3*a* that in turn is used for transmitting and/or receiving electromagnetic radiation via the first reflective metal surface 2.

21: Attaching at least a first reflective metal surface 2 to the common dielectric body 4.

22: Performing said attaching such that said first reflective metal surface 2 and said signal feeding arrangement 3*a* have a fixed relation to each other with a certain distance between them, enabling said transmitted and/or received electromagnetic radiation to at least partly propagate through at least a part of the common dielectric body 4.

According to an aspect, the method further comprises:

25: Attaching a second reflective metal surface 5 to the common dielectric body 4 such that said first reflective metal surface 2 and said second reflective metal surface 5 have a fixed relation to each other with a certain distance between them, enabling transfer of electromagnetic radiation between the first reflective metal surface 2 and the second reflective metal surface 5 by means of reflection.

According to an aspect, each reflective metal surface 2, 5; 2', 5', 6, 7 is attached to a corresponding outer surface 8*a*, 8*b*; 8*a*', 8*b*', 8*c*', 8*d*' of the common dielectric body 4, and according to another aspect, each reflective metal surface 2, 5 is applied to a corresponding outer surface 8*a*, 8*b*; 8*a*', 8*b*', 8*c*', 8*d*' as a layer of metallic coating.

According to an aspect, the common dielectric body is formed by using molding. Molding a dielectric is a low temperature process, providing very high precision and a long usage life for the molding tool.

The present disclosure is not limited to the examples above, but may vary within the scope of the appended claims. For example, the reflector antenna arrangement may only have one reflective metal surface, thus forming a traditional directly fed reflector antenna, not having any sub-reflector. On the other hand, according to aspect, the antenna arrangement comprises two or more sub-reflectors that are arranged to feed one main reflector. When two or more reflector arrangements are formed on and/or attached to the common dielectric body, the above is of course valid for one or more of these reflector arrangements.

Each reflective metal surface 2, 5; 2', 5', 6, 7 is according to some aspects arranged on a corresponding outer surface 8*a*, 8*b*; 8*a*', 8*b*', 8*c*', 8*d*' of the common dielectric body 4, 4', and may according to some aspects be arranged as corresponding layers of metallic coating on said corresponding outer surface 8*a*, 8*b*; 8*a*', 8*b*', 8*c*', 8*d*'. Such a coating may be applied in many ways, for example by screen-printing, by applying metal vapor or by applying an adhesive metal film.

Where each layer of metallic coating is applied, each corresponding outer surface 8*a*, 8*b*; 8*a*', 8*b*', 8*c*', 8*d*' has such a shape that a desired antenna reflector is formed.

For each metal surface 2, 5; 2', 5', 6, 7, there is a corresponding part of the outer surface 8*a*, 8*b*; 8*a*', 8*b*', 8*c*', 8*d*' to which that metal surface 2, 5; 2', 5', 6, 7 is arranged to be applied. Each such part of the outer surface 8*a*, 8*b*; 8*a*', 8*b*', 8*c*', 8*d*' has a defined limit within which limit the metal surface 2, 5; 2', 5', 6, 7 is arranged to be applied, where the surface within the limit suitably matches the metal surface 2, 5; 2', 5', 6, 7.

According to some aspects, the metal surfaces 2, 5; 2', 5', 6, 7 are in the form of pre-formed metal dishes that are attached to the common dielectric body 4, 4', for example by means of gluing. In this case, the common dielectric body 4 does not need to have outer surface parts 8*a*, 8*b*; 8*a*', 8*b*', 8*c*', 8*d*' that have shapes that match the corresponding reflective metal surfaces 2, 5; 2', 5', 6, 7. However, at least some kind of suitable mounting means are comprised in the outer surface parts 8*a*, 8*b*; 8*a*', 8*b*', 8*c*', 8*d*', for example protrusions and/or guides, such that a well-defined position of the metal surfaces 2, 5; 2', 5', 6, 7 is obtained on the common dielectric body 4, 4'.

The radio unit 18 has been described as comprised in the signal feeding arrangement 3*a*, 3*b*, 3*c*, 3*d*, 3*e*. As an alternative, the radio unit may be remote from the signal feeding arrangement and connected to the signal feeding arrangement via a cable or a waveguide.

Generally, the present disclosure relates to a reflector antenna arrangement 1 comprising at least a first reflective metal surface 2 and a signal feeding arrangement transition 15 that is adapted to receive a signal feeding arrangement 3*a* that in turn is adapted to transmit and/or receive electromagnetic radiation via the first reflective metal surface 2. The reflector antenna arrangement 1 further comprises a common dielectric body 4 comprising at least one dielectric material, to which common dielectric body 4 the first reflective metal surface 2 is attached in a fixed relation to the signal feeding arrangement transition 15 with a certain distance between them such that said transmitted and/or received electromagnetic radiation at least partly is arranged to propagate through at least a part of the common dielectric body.

According to an example, the reflector antenna arrangement 1 comprises a second reflective metal surface 5 attached to the common dielectric body 4 in a fixed relation to the first reflective metal surface 2 with a certain distance between them, where the first reflective metal surface 2 and the second reflective metal surface 5 are adapted for transfer of electromagnetic radiation between them by means of reflection.

According to an example, the reflector antenna arrangement 1' comprises a third reflective metal surface 6 attached to the common dielectric body 4' in a fixed relation to the signal feeding arrangement transition 15 with a certain distance between them.

According to an example, the reflector antenna arrangement 1' comprises a fourth reflective metal surface 7 attached to the common dielectric body 4' in a fixed relation to the third reflective metal surface 6 with a certain distance between them, where the third reflective metal surface 6 and the fourth reflective metal surface 7 are adapted for transfer of electromagnetic radiation between them by means of reflection.

According to an example, each reflective metal surface 2, 5; 2', 5', 6, 7 is arranged on a respective outer surface 8*a*, 8*b*; 8*a*', 8*b*', 8*c*', 8*d*' of the common dielectric body 4, 4'.

According to an example, each reflective metal surface 2, 5; 2', 5', 6, 77 is arranged as a layer of metallic coating on a respective outer surface 8*a*, 8*b*; 8*a*', 8*b*', 8*c*', 8*d*' of the common dielectric body 4, 4'.

According to an example, the common dielectric body 4, 4' is integrally formed.

According to an example, the common dielectric body 4, 4' is formed as one solid piece.

According to an example, the common dielectric body 4, 4' is formed as a hollow body.

According to an example, the common dielectric body 4" comprises at least two different dielectric materials 9, 10, 11 arranged in a layer structure.

According to an example, the common dielectric body 4, 4' comprises at least one surface part 12, 12', 13 that has a matched shaped that provides a desired antenna radiation pattern and reflection characteristics.

According to an example, each signal feeding arrangement transition 15 is arranged to receive at least one of:

- a circular feeding horn antenna 14*a* adapted to co-operate with a taper arrangement 15, 15' formed in the common dielectric body 4, 4';
- a square feeding horn antenna 14*b* adapted to co-operate with a taper arrangement 15, 15' formed in the common dielectric body 4, 4':
- a feeding array antenna 16, 17;
- an electrically controlled antenna 16, 17;
- a patch antenna arrangement 16;
- a slot antenna arrangement 17; and
- a dielectric rod 23 attached to a circular waveguide 24.

According to an example, each signal feeding arrangement 3*a* comprises a radio unit 18.

According to an example, the reflector antenna arrangement 1, 1' is integrally formed.

According to an example, the common dielectric body 4, 4' at least partly is formed in at least one of following materials, alone or in a mixture:

- PTFE, polytetrafluoroethylene, with or without re-enforcement;
- glass;
- PVC, polyvinylchloride;
- ceramics;
- PC, polycarbonate; and
- PU, polyurethane.

Generally, the present disclosure also relates to a method for manufacturing a reflector antenna arrangement 1, wherein the method comprises:

- 19: forming a common dielectric body 4 comprising at least one dielectric material;
- 20: forming a signal feeding arrangement transition 15 in the common dielectric body 4, where the signal feeding arrangement transition 15 is used for receiving a signal feeding arrangement 3*a* that in turn is used for transmitting and/or receiving electromagnetic radiation via the first reflective metal surface 2;
- 21: attaching at least a first reflective metal surface 2 to the common dielectric body 4; and
- 22: performing said attaching such that said first reflective metal surface 2 and said signal feeding arrangement transition 15 have a fixed relation to each other with a certain distance between them, enabling said transmitted and/or received electromagnetic radiation to at least partly propagate through at least a part of the common dielectric body 4.

According to an example, the method further comprises:

25: attaching a second reflective metal surface 5 to the common dielectric body 4 such that said first reflective metal surface 2 and said second reflective metal surface 5 have a fixed relation to each other with a certain distance between them, enabling transfer of electromagnetic radiation between the first reflective metal surface 2 and the second reflective metal surface 5 by means of reflection.

According to an example, each reflective metal surface 2, 5 is attached to a respective outer surface 8*a*, 8*b* of the common dielectric body 4.

According to an example, each reflective metal surface 2, 5 is applied to a respective outer surface 8*a*, 8*b* of the common dielectric body 4 as a layer of metallic coating.

According to an example, the common dielectric body 4 is formed by using molding.

The invention claimed is:

1. A reflector antenna arrangement comprising:

at least a first reflective metal surface and a signal feeding arrangement transition that is adapted to receive a signal feeding arrangement that in turn is adapted to transmit and/or receive electromagnetic radiation via the first reflective metal surface, wherein the reflector antenna arrangement further comprises a common dielectric body comprising at least one dielectric material, to which common dielectric body the first reflective metal surface is attached in a fixed relation to the signal feeding arrangement transition with a certain distance between them such that said transmitted and/or received electromagnetic radiation at least partly is arranged to propagate through at least a part of the common dielectric body; and wherein the reflector antenna arrangement comprises a second reflective metal surface attached to the common dielectric body in a fixed relation to the first reflective metal surface with a certain distance between them, where the first reflective metal surface and the second reflective metal surface are adapted for transfer of electromagnetic radiation between them by means of reflection and wherein the first and second reflective surfaces comprise non-colinear axes of symmetry.

2. The reflector antenna arrangement according to claim 1, wherein the first reflective metal surface and the second reflective metal surface have a parabolic shape.

3. The reflector antenna arrangement according to claim 1, wherein the reflector antenna arrangement comprises a third reflective metal surface attached to the common dielectric body in a fixed relation to the signal feeding arrangement transition with a certain distance between them.

4. The reflector antenna arrangement according to claim 3, wherein the reflector antenna arrangement comprises a fourth reflective metal surface attached to the common dielectric body in a fixed relation to the third reflective metal surface with a certain distance between them, where the third reflective metal surface and the fourth reflective metal surface are adapted for transfer of electromagnetic radiation between them by means of reflection.

5. The reflector antenna arrangement according to claim 1, wherein each reflective metal surface is arranged on a respective outer surface of the common dielectric body.

6. The reflector antenna arrangement according to claim 1, wherein each reflective metal surface is arranged as a layer of metallic coating on a respective outer surface of the common dielectric body.

7. The reflector antenna arrangement according to claim 1, wherein the common dielectric body is integrally formed.

8. The reflector antenna arrangement according to claim 1, wherein the common dielectric body is formed as one solid piece.

9. The reflector antenna arrangement according to claim 1, wherein the common dielectric body is formed as a hollow body.

10. The reflector antenna arrangement according to claim 1, wherein the common dielectric body comprises at least two different dielectric materials arranged in a layer structure.

11. The reflector antenna arrangement according to claim 1, wherein the common dielectric body comprises at least one surface part that has a matched shaped that provides a desired antenna radiation pattern and reflection characteristics.

12. The reflector antenna arrangement according to claim 1, wherein each signal feeding arrangement transition is arranged to receive at least one of:

a circular feeding horn antenna adapted to co-operate with a taper arrangement formed in the common dielectric body;

a square feeding horn antenna adapted to co-operate with a taper arrangement formed in the common dielectric body:

a feeding array antenna;

an electrically controlled antenna;

a patch antenna arrangement;

a slot antenna arrangement; and a dielectric rod attached to a circular waveguide.

13. The reflector antenna arrangement according to claim 12, wherein each signal feeding arrangement comprises a radio unit.

14. The reflector antenna arrangement according to claim 1, wherein the reflector antenna arrangement is integrally formed.

15. The reflector antenna arrangement according claim 1, wherein the common dielectric body at least partly is formed in at least one of following materials, alone or in a mixture:

PTFE, polytetrafluoroethylene, with or without re-enforcement;

glass;

PVC, polyvinylchloride;

ceramics;

PC, polycarbonate; and

PU, polyurethane.

16. A method for manufacturing a reflector antenna arrangement, wherein the method comprises:

forming a common dielectric body comprising at least one dielectric material;

forming a signal feeding arrangement transition in the common dielectric body, where the signal feeding arrangement transition is used for receiving a signal feeding arrangement that in turn is used for transmitting and/or receiving electromagnetic radiation via the first reflective metal surface;

attaching at least a first reflective metal surface to the common dielectric body and a second reflective metal surface, wherein the second reflective metal surface is attached in a fixed relation to the first reflective metal surface with a certain distance between them, where the first reflective metal surface and the second reflective metal surface are adapted for transfer of electromagnetic radiation between them by means of reflection and wherein the first and second reflective surfaces comprise non-colinear axes of symmetry; and performing said attaching such that said first reflective metal surface and said signal feeding arrangement transition have a fixed relation to each other with a certain distance between them, enabling said transmitted and/or received electromagnetic radiation to at least partly propagate through at least a part of the common dielectric body.

17. The method according to claim 16, wherein the first reflective metal surface and the second reflective metal surface have a parabolic shape.

18. The method according to claim 16, wherein each reflective metal surface is attached to a respective outer surface of the common dielectric body.

19. The method according to claim 16, wherein each reflective metal surface is applied to a respective outer surface of the common dielectric body as a layer of metallic coating.

20. The method according to claim 16, wherein the common dielectric body is formed by using molding.

* * * * *